United States Patent [19]

Bomberger, Jr. et al.

[11] 3,963,525

[45] June 15, 1976

[54] METHOD OF PRODUCING A HOT-WORKED TITANIUM PRODUCT

[75] Inventors: Howard B. Bomberger, Jr., Canfield; Stanley R. Seagle, Warren, both of Ohio

[73] Assignee: RMI Company, Niles, Ohio

[22] Filed: Oct. 2, 1974

[21] Appl. No.: 511,566

[52] U.S. Cl. ..... 148/2; 75/175.5; 148/11.5 F

[51] Int. Cl.[2] ..... C22F 1/18

[58] Field of Search ..... 29/527.7; 148/2, 3, 148/11.5; 72/365, 700; 75/175.5

[56] References Cited

UNITED STATES PATENTS

| | | | |
|---|---|---|---|
| 3,070,468 | 12/1962 | Grant | 75/175.5 X |
| 3,074,829 | 1/1963 | Novy et al. | 75/175.5 X |
| 3,112,196 | 11/1963 | Schier | 75/175.5 |
| 3,113,991 | 12/1963 | Kleber | 75/175.5 X |
| 3,378,671 | 4/1968 | Harrison et al. | 75/175.5 X |
| 3,379,522 | 4/1968 | Vordahl | 75/175.5 X |
| 3,622,406 | 11/1971 | Vordahl | 75/175.5 |
| 3,679,403 | 7/1972 | Bomberger et al. | 75/175.5 |

*Primary Examiner*—W. Stallard
*Attorney, Agent, or Firm*—Walter P. Wood

[57] ABSTRACT

A method of producing a hot-worked titanium product in which a minute quantity of a workability-enhancing agent is incorporated in the melting charge. The agent may be yttrium, a rare earth of atomic number 57 to 71, or combinations thereof, and may be in the form of the metal itself or a compound, such as the oxide. The agent has the effect of making bodies of the material more workable; that is, more drastic working is achieved without reheating of the material between hot-working steps, yet any significant surface-cracking is avoided in the product.

14 Claims, 13 Drawing Figures

METHOD OF PRODUCING A HOT-WORKED TITANIUM PRODUCT

This invention relates to an improved method of producing a hot-worked titanium product.

The term "titanium", when used herein without further qualification, refers to the various titanium-base alloys, such as Ti-5Al-2.5Sn, Ti-6Al-2Cb-1Ta-0.8Mo, Ti-6Al-4V, Ti-8Al-1Mo-1V, Ti-6Al-2Sn-4Zr-2Mo with or without added Si, etc., as well as the commercially pure metal itself. All percentages stated herein are by weight.

In working metal bodies, it is customary to express the amount of working in converting an ingot to a billet or in converting a billet to a bar or slab as the percentage by which the cross-sectional area of the body is reduced. For example, when a 36-inch diameter ingot of circular cross-section is worked to form a billet of rectangular cross-section of dimensions 24 by 30 inches, its cross-sectional area is reduced from about 1018 square inches to 720 square inches, and the amount of working is about 29 percent. When a body is upset axially or when a slab is rolled to form a plate or sheet, there may be no significant change in the cross-sectional area, and it is customary to express the amount of working as the percentage by which the height or thickness is reduced. For example, when a body is upset from a height of 2.75 inches to a height of 1.5 inches, as in examples stated hereinafter, the amount of working is about 45 percent. The term "percent working" as used herein means: (a) in working an ingot to form a billet or in working a billet to form a bar or slab, the percentage by which the cross-sectional area of the body is reduced; and (b) in upsetting a body axially or in rolling a slab to form a plate or sheet, the percentage by which the height or thickness of the body is reduced.

Conventional practice in hot-working titanium bodies, for example ingots, is to heat the body in a furnace to a suitable initial temperature, usually in the range of about 1700° to 2300°F, and subsequently reheat the body several times between working steps as it is forged or hot-rolled to its final shape. Initial working of an ingot usually is the most difficult working step. Each working step tends to become progressively less difficult as the grain structure of the body is refined. A conventional titanium ingot, heated to the foregoing temperature, may crack if it is worked more than about 15 to 20 percent in the initial working step without reheating. In forging a 36-inch diameter titanium ingot to a 4.75-inch thick slab, it is usually necessary to reheat the material at least three times back to a temperature approaching its initial working temperature between forging steps. Even though the later working steps are less difficult, the amount of working which can be achieved without reheating is quite limited. Usually it is necessary also to grind the surface of the product rather extensively at intermediate sizes to remove surface cracks. Grinding is a costly operation, and wastes valuable material.

An object of our invention is to provide an improved method of producing a hot-worked titanium product in which we largely overcome the need for reheating of the material, between working steps, yet avoid significant surface-cracking in the product.

A more specific object is to provide an improved method of producing a hot-worked titanium product in which we incorporate in the melting charge a minute quantity of a workability-enhancing agent, and subsequently hot-work the material at least about 30 percent in the initial working step without reheating, yet avoid any significant surface-cracking in the product.

A further object is to provide a titanium body having included therein a workability-enhancing agent, which body has the property that it can be hot-worked from a temperature of about 1700° to 2300°F to achieve at least about 30 percent working in the initial working step without reheating and without formation of surface cracks.

Figure 1:
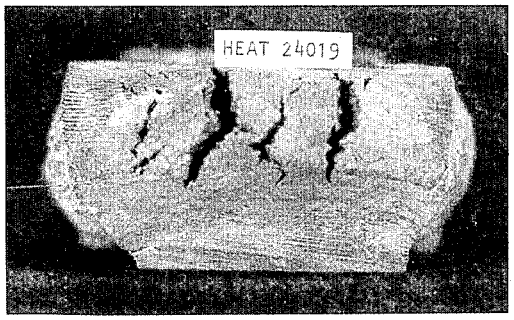
FIGS. 1 to 4 are photographs of forgings of the alloy Ti-5Al-2.5Sn containing different proportions of workability-enhancing agent (in this instance yttrium), each of which has been hot-worked as hereinafter described.

Our workability-enhancing agent may be the metals yttrium, a rare earth of atomic number 57 to 71, or a combination thereof, such as misch metal. Preferably the agent is used in the form of the oxide of one or more of these metals, but we can use the metals themselves, or other compounds as long as other elements present in the compound do not adversely affect the product or are within allowable limits. We include the agent in proportions less than 0.10 percent of the weight of the product, based on the weight of metal in the agent. We may use a content of agent even below 0.001 percent. The optimum content of agent varies for different alloys, but usually is about 0.001 to 0.05 percent. The benefits in workability diminish as the content of agent is increased above the optimum, and surprisingly are substantially lost if the content of agent is increased to about 0.10 percent or higher.

In practicing our invention, we make up a melting charge of titanium sponge, optionally titanium scrap, any desired alloying elements, and a minute quantity of workability-enhancing agent limited to less than 0.10 percent. We melt the charge thus made up to produce an ingot, using familiar techniques such as a consumable-electrode process or an electron-beam process. Advantageously we can double-melt or triple-melt the ingot as also known in the art. After removing the ingot from the mold, we heat it in a furnace to a suitable hot-working temperature, usually in the range of about 1700° to 2300°F. Using conventional equipment, we forge or hot-roll the ingot to achieve at least about 30 percent working in the initial working step without reheating it. We have been able to achieve as high as 90 percent working in titanium bodies which contain the agent without reheating the material, and yet avoid significant surface-cracking in the product. We also find we can substantially lessen the extent of surface grinding which is needed. Examples which follow demonstrate the benefits obtained by practice of our invention with respect to both 4-inch diameter laboratory-size ingots and 36-inch and 30-inch diameter commercial-size ingots.

EXAMPLE I

We made up 4-inch diameter 5-pound ingots, double-melted by a conventional consumable-electrode process, of an alloy having the nominal composition Ti-5Al-2.5Sn, plus varying additions of yttria ($Y_2O_3$) and in one instance yttrium metal. We ground each ingot to remove surface defects and forged the ingot to 1.75-inch thick plate from an initial furnace temperature of 2000F without reheating it. Next we cleaned the plates by sand-blasting and grinding. We cut sections 1.75 by 1.75 by 2.75 inches from the plates, heated the sections at a furnace temperature of 1600°F, soaked them for 30 minutes at this temperature, and upset the sections by press-forging from 2.75 inches to 1.5 inches high, without reheating them. The results were as follows:

| Heat No. | Alloy Compositions, Weight Percents | Surface Condition of Upset Forgings |
|---|---|---|
| 24019 | Ti-5Al-2.5Sn-0.2Fe (Control) | Severe Cracking |
| 24225 | Ti-5Al-2.5Sn-0.2Fe + 0.00126$Y_2O_3$(.001Y) | No Cracking |
| 24020 | Ti-5Al-2.5Sn-0.2Fe + 0.05$Y_2O_3$(.04Y) | Very Slight Cracking |
| 24226 | Ti-5Al-2.5Sn-0.2Fe + 0.126$Y_2O_3$(.10Y) | Slight Cracking |
| 24257 | Ti-5Al-2.5Sn-0.2Fe + 0.04Y | Very Slight Cracking |

Figure 2:
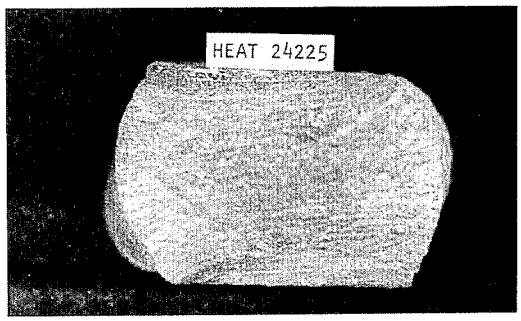
Figure 3:
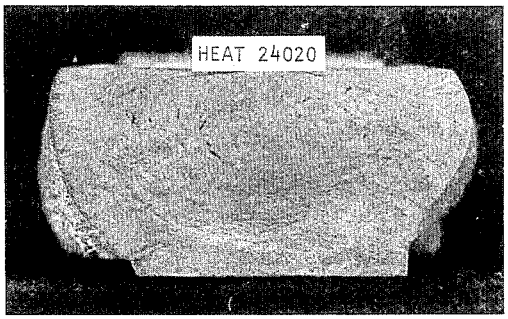
Figure 4:
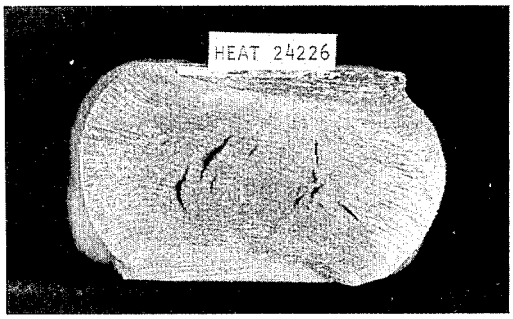

FIGS. 1 to 4 are photographs of the first four upset forgings listed in the foregoing table. FIG. 1 shows the control forging to which we added no yttrium, and which cracked severely when subjected to the hot-working procedure described. FIGS. 2, 3 and 4 show the forgings to which we added yttria equivalent to proportions of 0.001%, 0.04% and 0.10% yttrium respectively. The forging shown in FIG. 2 is free of cracks, while the forgings shown in FIGS. 3 and 4 exhibit progressively increasing cracking as we increased the yttrium content. In this instance the optimum yttrium content appears to be about 0.001%.

It should be noted that heats No. 24020 and No. 24257, which contain the same quantity of yttrium, but added in different forms, show similar properties.

EXAMPLE II

We made up ingots ase described in Example 1 of an alloy having the nominal composition Ti-6Al-2Cb-1Ta-0.8Mo. We followed the same procedure in working these ingots, except that in the reheating step the furnace temperature was 1850F, and we soaked the sections for four hours at this temperature. The results were as follows:

| Heat No. | Alloy Compositions, Weight Percents | Surface Condition of Upset Forgings |
|---|---|---|
| 24042 | Ti-6Al-2Cb-1Ta-0.8Mo (Control) | Severe Cracking |
| 24215 | Ti-6Al-2Cb-1Ta-0.8Mo + 0.025$Y_2O_3$(.02Y) | No Cracking |
| 24043 | Ti-6Al-2Cb-1Ta-0.8Mo + 0.05$Y_2O_3$(.04Y) | Slight Cracking |
| 24216 | Ti-6Al-2Cb-1Ta-0.8Mo + 0.075$Y_2O_3$(.06Y) | Moderate to Severe Cracking |

Figure 5:
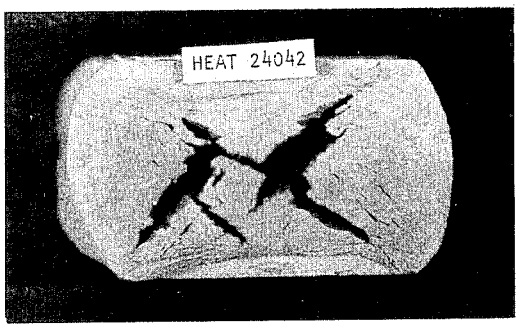
FIGS. 5 to 8 are similar photographs, but in which the alloy is Ti-6Al-2Cb-1Ta-0.8Mo.
Figure 6:
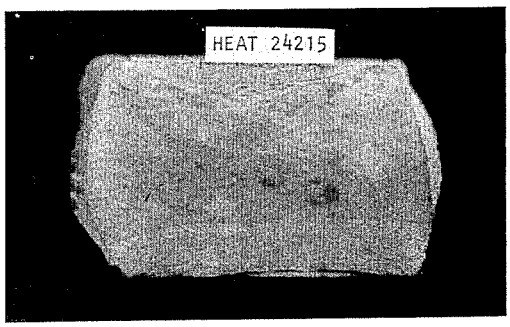
Figure 7:
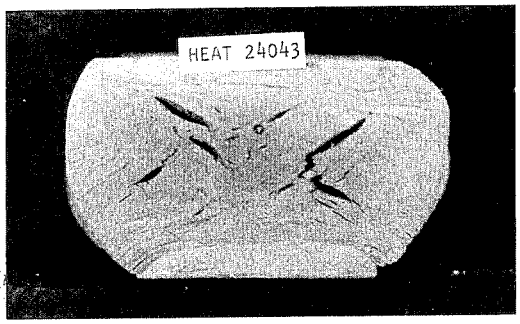
Figure 8:
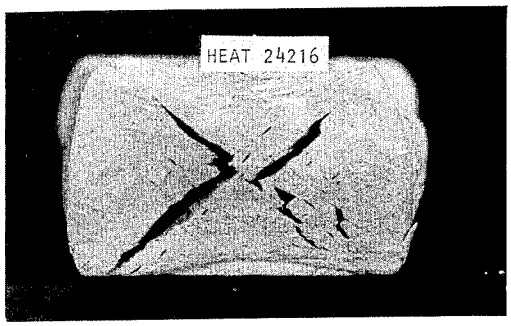

FIGS. 5 to 8 are photographs of the upset forgings listed in this second table. FIG. 5 shows the control forging to which we added no yttrium, and which again cracked severely when subjected to the hot-working procedure described. FIGS. 6, 7 and 8 show the forgings to which we added yttrium in proportions of 0.02%, 0.04%, and 0.06% respectively. The forging shown in FIG. 6 is free of cracks, while the forgings shown in FIGS. 7 and 8 exhibit progressively increasing cracking as we increased the yttrium content. In this instance the optimum yttrium content appears to be about 0.02%.

EXAMPLE III

We made up ingots as described in Example 1 of an alloy having the nominal composition Ti-6Al-4V, which presently is the most widely used titanium-base alloy. Again we followed the same procedure in working these ingots, except that in the reheating step the furnace temperature was 1650°F. The results were as follows:

| Heat No. | Alloy Compositions, Weight Percents | Surface Condition of Upset Forgings |
|---|---|---|
| 24045 | Ti-6.2Al-4V-0.18Fe (Control) | Severe Cracking |
| 24046 | Ti-6.2Al-4V-0.18Fe + 0.01$Y_2O_3$(0.008Y) | No Cracking |
| 24047 | Ti-6.2Al-4V-0.18Fe + 0.02$Y_2O_3$(0.016Y) | Very Slight Cracking |
| 24048 | Ti-6.2Al-4V-0.18Fe + 0.03$Y_2O_3$(0.024Y) | Very Slight Cracking |
| 24049 | Ti-6.2Al-4V-0.18Fe + 0.05$Y_2O_3$(0.04Y) | Slight Cracking |

Figure 9:
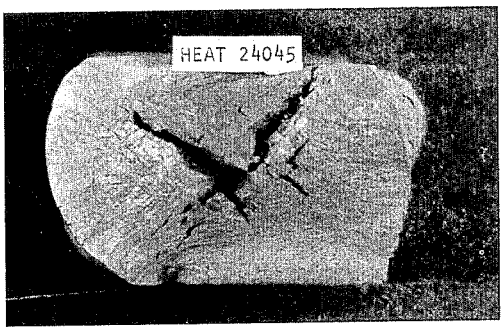
FIGS. 9 to 13 are similar photographs, but in which the alloy is Ti-6Al-4V.
Figure 10:
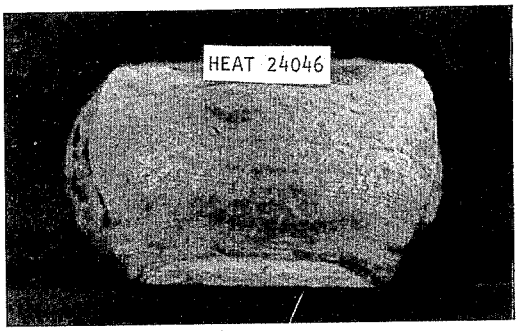
Figure 11:
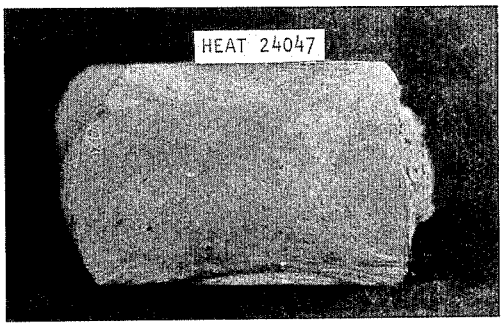
Figure 12:
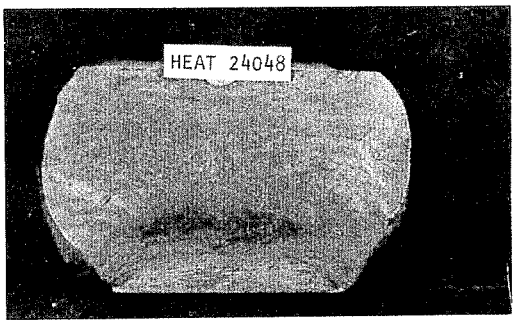
Figure 13:
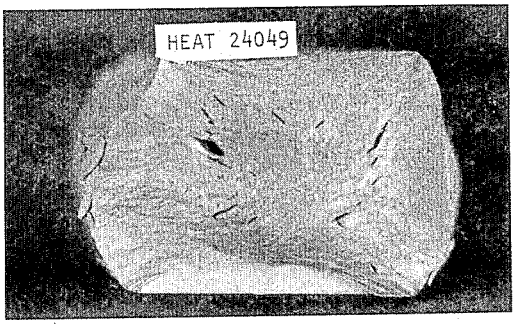

FIGS. 9 to 13 are photographs of the upset forgings listed in the third table. FIG. 9 shows the control forging to which we added no yttrium, and which again cracked severely when subjected to the hot-working procedure described. FIG. 10, 11, 12 and 13 show the forgings to which we added yttrium in proportions of 0.008%, 0.016%, 0.024% and 0.04% respectively. The forging shown in FIG. 10 is free of cracks, and those shown in FIGS. 11 and 12 nearly so. The forging shown in FIG. 13 exhibits increased cracking. The optimum yttrium content appears to be about 0.008%.

EXAMPLE IV

We prepared a 36-inch diameter commercial size ingot of the alloy Ti-6Al-4V without incorporating any workability-enhancing agent in the melting charge and a similar ingot in which we incorporated 0.050 percent $Y_2O_3$ (equivalent to 0.040 percent Y). We forged the ingots to 4.75-inch thick slabs. In conducting the operation described in these tables, we measured the thickness of the body accurately after each forging step, but we measured the width only approximately. An accurate measurement of width is difficult to obtain, since the sides of the body bulge and the width is not uniform. We have not stated the length since this dimension is not relevant in determining the percent working. The procedures followed were:

| Ingot No. 801306 — No Yttrium Added | Ingot No. X801368 — 0.05% $Y_2O_3$ Added |
|---|---|
| Ingot heated to 2100F | Ingot heated to 2100F |
| Forged to 26" × 36" × L (8% Working) | Forged in steps to 4.75" × 48" × L (77.6% Working) |
| Reheated to 2100F | Ground as needed prior to rolling |
| Forged to 16" × 49.5" × L (15% Working) | |
| Reheated to 2100F | |
| Forged to 8" × 49.5" × L (50% Working) | |
| Ground all over | |
| Heated to 1925F | |
| Forged to 4.75" × 48" × L (42% Working) | |
| Ground all over prior to rolling | |

The ingot to which no yttrium was added required three reheating steps to enable it to be forged to a billet of 4.75 inches thickness. The ingot to which yttrium was added in accordance with our invention required no reheating to enable it to be forged to a similar thickness, yet the product was free of significant cracks.

EXAMPLE V

We repeated the steps described in Example 4 with 30-inch diameter ingots of the alloy Ti-8Al-1Mo-1V. The procedures were:

| Ingot No. 801403 — No Yttrium Added | Ingot No. X891628 — 0.05% $Y_2O_3$ Added |
|---|---|
| Ingot heated to 2100F | Ingot heated to 2100F |
| Forged to 24" × 28" × L (5% Working) | Forged in steps to 4.75" × 48" × L (68% Working) |
| Reheated to 2100F | Ground as needed prior to rolling |
| Forged to 16" × 40" × L (5% Working) | |
| Reheated to 2100F | |
| Forged to 8" × 49.5" × L (38% Working) | |
| Ground all over | |
| Heated to 1975F | |
| Forged to 4.5" × 48" × L (45% Working) | |
| Ground all over prior to rolling | |

Again the ingot to which no yttrium was added required three reheating steps, while the ingot to which yttrium was added required none.

EXAMPLE VI

We made up 4-inch diameter 5-pound ingots of the alloy Ti-5Al-2.5Sn as in Example I, but added oxides of the rare earths neodymium, cerium and lanthanum, instead of ytrrium. We followed the same procedure as described in Example I in working these ingots. Heat No. 24234 contained 0.10 percent neodymium, which is just outside the range of our invention. The section cut from the ingot was difficult to upset and required reheating before we could complete the operation. The results were as follows:

| Heat No. | Alloy Compositions, Weight Percents | Surface Condition of Upset Forgings |
|---|---|---|
| 24019 | Ti-5Al-2.5Sn-0.2Fe (Control) | Severe Cracking |
| 24253 | Ti-5Al-2.5Sn-0.2Fe + 0.00117$Nd_2O_3$(.001Nd) | No Cracking |
| 24234 | Ti-5Al-2.5Sn-0.2Fe + 0.117$Nd_2O_3$(.10Nd) | No Cracking |
| 24255 | Ti-5Al-2.5Sn-0.2Fe + 0.023 $Ce_2O_3$(0.02Ce) | No Cracking |
| 24256 | Ti-5Al-2.5Sn-0.2Fe + 0.023$La_2O_3$(.02La) | No Cracking |

In addition we have tested small button melts of titanium to which we have added other rare earths, including samarium, praseodymium, erbium, gadolinium, dysprosium and combinations, such as misch metal and cerium-free misch metal. We have observed beneficial results with the other rare earths which we have tested.

The present invention should not be confused with the inventions described either in our earlier Pat. No. 3,679,403, or in Vordahl Pat. No. 3,622,406. Our earlier patent describes a method of improving the macrostructure of titanium-base alloys (not applicable to commercially pure titanium) in which we incorporate in the alloy about 0.03 to 0.40 percent of ytrrium. Yttrium at such levels lowers the tensile strength of the product, but we compensate for this by increasing the content of strengthening agents, such as oxygen or nitrogen, to levels slightly above those normally present in the alloy. Vordahl describes an article formed of titanium and 0.1 to 6 percent of a dispersoid insoluble in solid titanium but soluble in molten titanium. Yttrium and rare earth metals are mentioned as possible dispersoids. The dispersoid is dissolved in molten titanium, which is solidified as fine shot or flakes later consolidated by techniques used in powder metallurgy. The dispersoid is said to improve the creep properties of the product and also its resistance to hot-salt corrosion cracking. Both disclosures utilize yttrium or rare earths in proportions substantially above the upper limit which is effective for improving the hot-workability of the material. Necessarily they do not recognize that any improvement in the hot-workability results by virtue of inclusion of yttrium or rare earth metals. Neither suggests eliminating reheating steps during hot-working. From the Fromthe foregoing description it is seen that our invention achieves the unexpected advantage of enabling titanium bodies to be hot-worked drastically without the need for reheating the body between working steps, yet avoids significant surface-cracking in the product. The operating benefits of our method are extremely important in saving the cost of additional reheating of the material, and in speeding the operation.

We claim:

1. A method of producing a hot-worked titanium product comprising making up a melting charge of titanium or a titanium-base alloy and a workability-enhancing agent selected from the group consisting of the metals yttrium, a rare earth of atomic number 57 to 71, and combinations thereof, the agent being included in an amount of about 0.001 to 0.10 percent of the weight of the charge and being initially in the form of the metal itself or a compound thereof, melting said charge and casting it to form an ingot, heating said ingot to a temperature of about 1700 to 2300F, and hotworking the ingot to achieve about 30 to 90 percent working in the initial working step without reheating and without producing significant surface-cracking in the product.

2. A method as defined in claim 1 in which the agent is included in an amount of about 0.001 to 0.05 percent.

3. A method as defined in claim 1 in which said agent is yttrium and is initially in the form of a compound thereof.

4. A method as defined in claim 1 in which said compound is the oxide.

5. A method as defined in claim 1 in which said agent is a rare earth.

6. A method as defined in claim 1 in which said agent is selected from the group consisting of yttrium, neodymium, cerium, lanthanum, samarium, praseodymium, erbium, gadolinium, dysprosium, and combinations thereof.

7. A method as defined in claim 1 in which said charge consists of said agent and a titanium-base alloy of the group consisting nominally of Ti-5Al-2.5Sn, Ti-6Al-2Cb-1Ta-0.8Mo, Ti-6Al-4V, Ti-8Al-1Mo-1V, and Ti-6Al-2Sn-4Zr-2Mo with or without added Si.

8. A method as defined in claim 7 in which said agent is a rare earth.

9. A method as defined in claim 7 in which said agent is selected from the group consisting of yttrium, neodymium, cerium, lanthanum, samarium, praseodymium, erbium, gadolinium, dysprosium, and combinations thereof.

10. A method as defined in claim 7 in which said agent is yttrium and is initially in the form of a compound thereof.

11. A method as defined in claim 8 in which said compound is the oxide.

12. A method of producing a hot-worked titanium product comprising casting a body of titanium or a titanium-base alloy and a workability-enhancing agent selected from the group consisting of the metals yttrium, a rare earth of atomic numbers 57 to 71, and combinations thereof, the agent being included in an amount of 0.001 to 0.10 percent and being initially in a form of the metal itself or a compound thereof, heating said body to a temperature of about 1700° to 2300°F, and hot-working the heated body to achieve about 30 to 90 percent working in the initial working step without reheating and without producing significant surface-cracking in the product.

13. A method as defined in claim 12 in which said agent is yttrium and is initially in the form of the oxide.

14. A method as defined in claim 12 in which said body consists of said agent and a titanium-base alloy of the group consisting nominally of Ti-5Al-2.5Sn, Ti-6Al-2Cb-1Ta-0.8Mo, Ti-6Al-4V, Ti-8Al-1Mo-1V, and Ti-6Al-2Sn-4Zr-2Mo with or without added Si.

* * * * *